United States Patent [19]

Nicholls

[11] 3,974,469

[45] Aug. 10, 1976

[54] PERMANENT MAGNET BIASING MEANS FOR REED SWITCHES

[75] Inventor: Bryan Frederick Nicholls, Northampton, England

[73] Assignee: The Mettoy Company Limited, Northampton, England

[22] Filed: Feb. 13, 1975

[21] Appl. No.: 549,475

[30] Foreign Application Priority Data

Feb. 14, 1974 United Kingdom ..... 6831/74

[52] U.S. Cl. ..... 335/153; 335/205

[51] Int. Cl.[2] ..... H01H 1/66

[58] Field of Search ..... 335/151, 153, 154, 152, 335/205, 206, 207

[56] References Cited

UNITED STATES PATENTS

| | | | |
|---|---|---|---|
| 3,227,838 | 1/1966 | Hoeppel | 335/153 |
| 3,250,955 | 5/1966 | Krikac | 335/207 X |
| 3,448,419 | 6/1969 | Myatt | 335/207 X |
| 3,559,124 | 1/1971 | Posey | 335/205 |

*Primary Examiner*—George Harris
*Attorney, Agent, or Firm*—Brisebois & Kruger

[57] ABSTRACT

A magnetic switch assembly including a reed switch is biased by moving the magnetic axis of a permanent magnet with respect to the axis of the reed switch. In one embodiment, the magnet is a disc magnet which is provided with diametrically opposite poles the magnetic axis of the magnet being rotated in a plane spaced from the reed switch. In a further embodiment the magnet is a bar magnet disposed with its magnetic axis parallel to and aligned with the axis of the reed switch. A screw-threaded member received in a bore in the magnet is rotated to move the magnet towards and away from the reed switch to vary the magnetic biasing conditions, guide means are disclosed abutting the magnet so as to maintain the disposition of the magnet with respect to the reed switch during movement of the magnet.

1 Claim, 7 Drawing Figures

PERMANENT MAGNET BIASING MEANS FOR REED SWITCHES

BACKGROUND OF THE INVENTION

This invention relates to reed switches, that is switches having contacts operated by, and usually carried by, magnetic members, the switches being operated by varying the magnetic field conditions in the region of the magnetic members.

SUMMARY OF THIS INVENTION

The invention has for its object to provide an improved mounting for a reed switch.

The present invention provides a reed switch assembly comprising a reed switch, and a permanently magnetised member, both mounted on a body, said member being arranged for movement on said body with respect to said reed switch for altering the ambient magnetic flux in the region of the switch reeds.

DESCRIPTION OF THE DRAWINGS

Features and advantages of the invention will appear from the following description of embodiments thereof given by way of example, and the accompanying drawings, in which.

DETAILED DESCRIPTION

Figure 1:
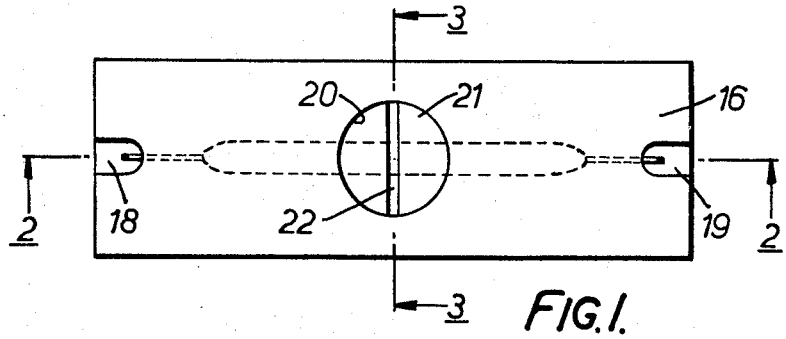
FIG. 1 is a plan view of a reed switch assembly.
Figure 2:
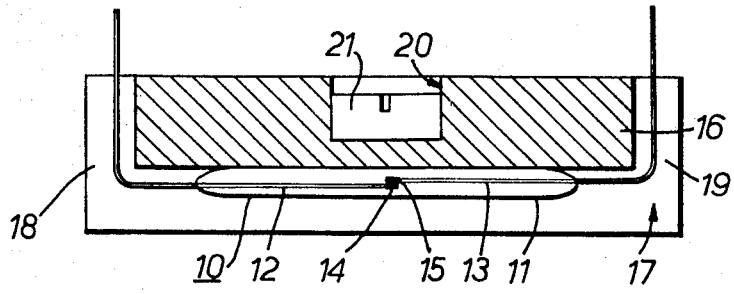
FIG. 2 is a longitudinal sectional view through the reed switch assembly of FIG. 1 taken on the line 2—2.
Figure 3:
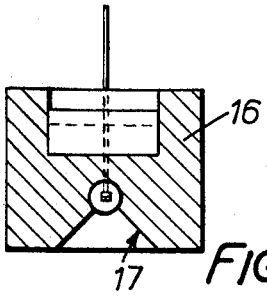
FIG. 3 is a transverse section taken on the line 3—3 of FIG. 2.

The assembly shown in the drawings includes the reed switch 10, comprising a glass tubular envelope 11 in the respective ends of which are sealed contact members 12 and 13. Within the envelope the contact members are formed as flexible blades, or so-called reeds, of magnetic material terminating in contacts 14 and 15. The envelope is filled with an inert gas, or is at reduced pressure, or both.

Such a reed switch can be operated by varying the magnetic field conditions in the vicinity of the magnetic reeds. Usually, the reeds have a position of rest in which the adjacent contacts are separated; by increasing the magnetic flux the reeds are drawn magnetically together, causing the contacts to engage and establish a circuit between the externally accessible parts of the contact members. In some forms of reed switches the contacts may changeover, or open, from the rest position.

The switches may operate in response to a magnetic field produced by a moving permanent magnet or by a field produced electromagnetically and in many applications it is desirable that the switch should operate in response to a particular change of flux density, and though it is possible to control the initial flux conditions and thus procure that the contacts will operate in response to a given flux change, the adjustment is so inconvenient to make that it is more usual for tolerance on operation to be more closely set.

The assemblies shown in the drawings afford a reed switch mounting with a very simple means of adjusting the ambient flux in the region of the switch reeds, to an extent which permits the use of relatively wide tolerance switches, at correspondingly lower cost for a given performance.

FIGS. 1 to 4 show an assembly which includes a body 16 of insulating material, preferably a material which has a degree of resiliency. One face of the body, which can be identified as the back, is formed with a recess 17 with a groove into which the reed switch can be pressed, to be held by friction. The switch leads can emerge forwardly through end grooves 18, 19, as shown, or the leads can emerge axially, as may be convenient.

Figure 4:
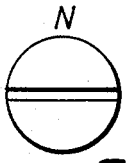
FIG. 4 is a detail of the adjusting magnet.

In the front face of the body is a recess 20 in which fits a small disc-shaped permanent magnet 21 conveniently of ferrite. The magnet is a frictional fit in the recess, and is formed with a screw driver slot 22, so that it can be turned, in the recess about the axis of the circular face of the disc. The magnet is magnetised with the lines of force running diametrically, as shown in FIG. 4, so that the N and S poles appear at opposite ends of a diameter of the disc.

It will be seen that if the reed switch responds to an increase of flux in the direction along its length, the flux from magnet 21 depending upon the angular position of the magnet aid or oppose the operating flux or in the intermediate positions have neutral positions not affecting the operating flux.

The back of the body can be closed by a cover secured by adhesive, or clipped on, or otherwise attached. If the body, or the cover, is or are of a rubber or like frictionally lossy material, the body assists in reducing the noise which may be generated by operation of the switch, more particularly when the switch is used at relatively high frequency.

The body can be of any convenient shape, and can be formed with mounting means, such as screw apertures, or flanges.

Figure 5:
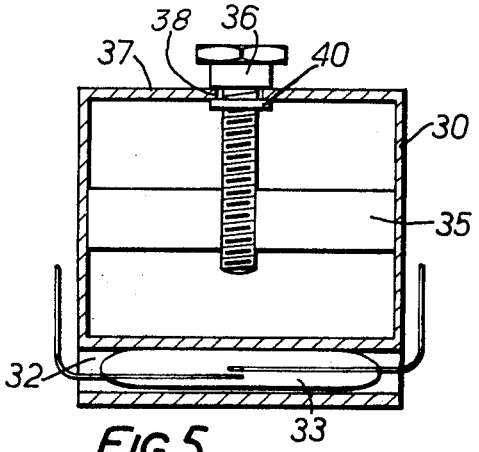
FIG. 5 is a sectional side view through a further reed switch assembly.
Figure 6:
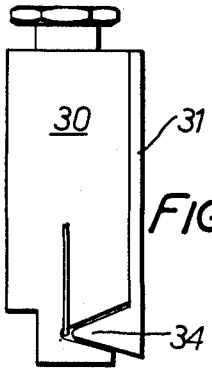
FIG. 6 is a side view of the assembly of FIG. 5.
Figure 7:
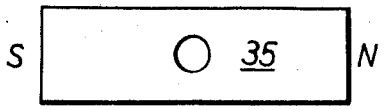
FIG. 7 is a plan view of the adjusting magnet.

In the assembly shown in FIGS. 5 to 7, a change in the ambient flux in the region of the switch reeds is procured by causing a permanent magnet, whose magnetic axis is aligned with the reeds, to approach or move away from the reeds.

The assembly includes a body 30 of insulating material which is generally of box-like configuration having a closure member 31. One of the side surfaces of the body 30 is provided with a recess 32 for receiving a reed switch 33. The switch leads emerge from the ends of the recess and can be bent along the sides adjacent the groove, as shown, or can emerge axially of the reed switch, as is convenient. The reed switch can be retained in the recess 32 either by friction, or, as shown, by projections on a presser portion 34 on the closure member, which projections trap the switch leads in the recess 32.

A permanent magnet in the form of a ferrite bar magnet 35 is housed within the body 30 and is a sliding fit therein so that it cannot rotate. The magnet 35 is moved within the housing by rotation of a captive coarsely threaded screw 36 which is in threaded engagement with a hole through the magnet 35. The screw 36 is retained on the side 37 of the housing which is opposite to that provided with the recess 32 by the edges of a slot 38 in the side 37 which allows the screw to be mounted on the body 30 being received between the head of the screw 36 and a shoulder 40 on the screw. The screw is thus held captive on the body but is still able to rotate.

In use, the ambient flux in the region of the switch reeds is adjusted to cause the reeds to open or close, as desired, at a predetermined value of magnetic flux by rotating the screw 36. This causes the bar magnet 35 to move towards or away from the reed switch 33 in the plane of movement of the switch reeds with the bar magnet maintained aligned with and parallel to the reed switch by virtue of the magnet being a sliding fit in the body 30.

It has been found that this arrangement is particularly convenient since the magnet 35 acts in much the same way as a self-locking nut when used with a coarse threaded plastics screw.

The body can be formed with mounting means such as screw apertures, or flanges and the closure can be secured to the body by adhesive, or clipped on, or otherwise attached. The body is preferably of plastics material which reduces the noise generated by operation of the reed switch.

The constuctions described are particularly suited to use with a permanent magnet rotor electric motor such as that described in our co-pending application No. 18389/72.

The body of material, or a composite body, can also be loaded with magnetic material disposed to modify the field conditions or to provide magnetic screening of the unit, or adjacent units.

What is claimed is:

1. A magnetic switch assembly arranged to be responsive to a change in magnetic conditions near said assembly, the assembly comprising a reed switch having switch reeds, a housing for retaining said reed switch, a permanently magnetised bar magnet in said housing for producing a biasing ambient magnetic field around said reed switch, said bar magnet being mounted with its magnetic axis parallel to and in the plane of movement of said switch reeds, means for moving said bar magnet towards and away from the reed switch in the direction of movement of the switch reeds to alter the biasing magnetic field, and guide means on the interior walls of the housing abutting the bar magnet to maintain the magnetic axis of the bar magnet parallel to and aligned with the axis of the reed switch during movement of the magnet towards and away from the reed switch, said moving means comprising a screw threaded member received in a bore in the bar magnet.

* * * * *